US010783817B2

(12) United States Patent
Qiu

(10) Patent No.: US 10,783,817 B2
(45) Date of Patent: Sep. 22, 2020

(54) DRIVING CIRCUIT, LEVEL SHIFTER CHIP, AND DISPLAY DEVICE

(71) Applicants: Chongqing HKC Optoelectronics Technology Co., Ltd., Chongqing (CN); HKC Corporation Limited, Shenzhen, Guangdong (CN)

(72) Inventor: Bin Qiu, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/254,617

(22) Filed: Jan. 23, 2019

(65) Prior Publication Data

US 2020/0098296 A1 Mar. 26, 2020

Related U.S. Application Data

(63) Continuation of application No. PCT/CN2018/113346, filed on Nov. 1, 2018.

(30) Foreign Application Priority Data

Sep. 21, 2018 (CN) ..... 2018 1 1111985

(51) Int. Cl.
*G09G 3/20* (2006.01)

(52) U.S. Cl.
CPC ..... *G09G 3/20* (2013.01); *G09G 2310/0286* (2013.01); *G09G 2310/0289* (2013.01); *G09G 2310/06* (2013.01); *G09G 2310/08* (2013.01)

(58) Field of Classification Search
CPC ..... G09G 3/20; G09G 2310/0286; G09G 2310/0289; G09G 2310/06; G09G 2310/08
See application file for complete search history.

(56) References Cited

U.S. PATENT DOCUMENTS

2002/0075248 A1 6/2002 Morita et al.
2016/0012802 A1* 1/2016 Woo ..... G09G 5/395 345/560

FOREIGN PATENT DOCUMENTS

| | | | |
|---|---|---|---|
| CN | 102144253 | A | 8/2011 |
| CN | 102156366 | A | 8/2011 |
| CN | 103927962 | A | 7/2014 |
| CN | 105448261 | A | 3/2016 |
| CN | 106128351 | A | 11/2016 |
| CN | 107395006 | A | 11/2017 |
| CN | 108053788 | A | 5/2018 |
| CN | 108109566 | A | 6/2018 |

* cited by examiner

*Primary Examiner* — Dmitriy Bolotin

(57) ABSTRACT

Disclosed are a driving circuit, a level shifter IC and a display device. The driving circuit includes a level enhancing module, a switch module, a current detecting module and a control module, the control module correspondingly switches on the switch module or switches off the switch module according to current signal output by the current detecting module.

18 Claims, 4 Drawing Sheets

DRIVING CIRCUIT, LEVEL SHIFTER CHIP, AND DISPLAY DEVICE

CROSS REFERENCE TO RELATED APPLICATIONS

The present application is a Continuation Application of PCT Application No. PCT/CN2018/113346 filed on Nov. 1, 2018, which claims the benefit of Chinese Patent Application No. 201811111985.X filed on Sep. 21, 2018. All the above are hereby incorporated by reference.

FIELD

The present disclosure relates to the field of display panel technology, and more particularly relates to a driving circuit, a level shifter chip, and a display device.

BACKGROUND

With the increasing demand for narrow-border televisions, a new type of gate driver on array driver (GOA) architecture is getting more and more popular. In the general display panel, a gate IC is bound on a panel, thus, a further narrowing of the border would be limited by the size of the gate IC. In recent years, with the advent of the new type of GOA technology, the traditional driving way has been gradually replaced. The GOA circuit is a circuit in which the original Gate IC is divided into two parts including a level shifter chip (level shifter IC) and a shift register. The level shifter chip is manufactured on the driver board, and the shift register is on the panel. The level shifter chip transmits CLK to the shift register for driving. As such, the structure of the Gate IC is simplified, and further, the border length is reduced.

In the manufacture process of the GOA, shift registers are provided on both the left and right sides of the panel, so as to implement bilateral driving. Considering that instability may occur in the manufacture process, and damage may be caused to one shift register during operation, an abnormal display may be generated. Because there is a probability for the shift register on either side to be damaged, it is impossible to fix one of the driving ways. Currently, three driver boards are developed in one panel, which are respectively used to drive the shift register on left side only, the shift register on the right side only, and the shift registers on both the left and right sides. It is passively determined that which driver board works according to actual damage status of the shift register, which is costly, laborious and time-consuming. And if the size of the display panel is large, the charging time for the remote may be insufficient when unilateral driving.

SUMMARY

It is one main objective of the present disclosure to provide a driving circuit, aiming to improve compatibility of the driver board, and reduce design costs.

In order to realize the above aim, the present disclosure provides a driving circuit, the driving circuit includes:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively including a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups, and feed back a plurality of current signals to the control module; and a control module, configured to receive the plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

Optionally, a signal input end of the potential enhancing module connects to a signal output end of the timing sequence controller, a signal output end of the potential enhancing module connects to a signal input end of the current detecting module, a signal output end of the current detecting module connects to a signal input end of the switch module, a first signal output end of the switch module connects to a signal input end of the first shift register of the display panel, a second signal output end of the switch module connects to a signal input end of the second shift register of the display panel, a controlled end of the potential enhancing module, the signal output end of the current detecting module, and a controlled end of the switch module all connect to a signal end of the control module.

Optionally, the switch module includes a first sub-switch module, a second sub-switch module and a third sub-switch module, a first signal end of the first sub-switch module, a first signal end of the third switch are connected to a first signal output end of the current detecting module, a second signal end of the first sub-switch module is connected to a signal end of the first shift register of the display panel, a first signal end of the sub-second switch module, a second signal end of the third sub-switch module are connected to the second signal output end of the current detecting module, a second signal end of the second sub-switch module is connected to a signal end of the right shift register of the display panel, a controlled end of the first sub-switch module, a controlled end of the second sub-switch module and a controlled end of the third sub-switch module are connected to a control end of the control module.

Optionally, the first sub-switch module, the second sub-switch module and the third sub-switch module all comprise a plurality of switch circuits, a first end of each of the switch circuits in the first sub-switch module is connected to a first end of a corresponding switch circuit in the second sub-switch module via a corresponding switch circuit in the third sub-switch module, outputting the two clock signal groups, including the plurality of sub-clock signals, to the two shift registers located on the display panel, respectively via the plurality of the switch circuits in the first switch module and the plurality of the switch circuits in the second switch module, a controlled end of each of the switch circuits is respectively connected to the control end of the control module.

Optionally, the plurality of switch circuits of each sub-switch module are linked together.

Optionally, each of the switch circuits is a metal-oxide semiconductor field effect transistor.

Optionally, each of the switch circuits is a triode.

Optionally, the current detecting module includes a plurality of sub-current detecting modules, each of the sub-current detecting modules respectively detects current of each of the sub-clock signals, and feeds back current signal to the control module.

The present disclosure further provides a level shifter chip:

a level shifter chip, the enhancing chip includes a driving circuit, the driving circuit includes:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively including a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups, and feed back a plurality of current signals to the control module; and a control module, configured to receive the plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

Optionally, a signal input end of the potential enhancing module connects to a signal output end of the timing sequence controller, a signal output end of the potential enhancing module connects to a signal input end of the current detecting module, a signal output end of the current detecting module connects to a signal input end of the switch module, a first signal output end of the switch module connects to a signal input end of the first shift register of the display panel, a second signal output end of the switch module connects to a signal input end of the second shift register of the display panel, a controlled end of the potential enhancing module, the signal output end of the current detecting module, and a controlled end of the switch module all connect to a signal end of the control module.

Optionally, the switch module includes a first sub-switch module, a second sub-switch module and a third sub-switch module, a first signal end of the first sub-switch module, a first signal end of the third switch are connected to a first signal output end of the current detecting module, a second signal end of the first sub-switch module is connected to a signal end of the first shift register of the display panel, a first signal end of the sub-second switch module, a second signal end of the third sub-switch module are connected to the second signal output end of the current detecting module, a second signal end of the second sub-switch module is connected to a signal end of the right shift register of the display panel, a controlled end of the first sub-switch module, a controlled end of the second sub-switch module and a controlled end of the third sub-switch module are connected to a control end of the control module.

Optionally, the first sub-switch module, the second sub-switch module and the third sub-switch module all comprise a plurality of switch circuits, a first end of each of the switch circuits in the first sub-switch module is connected to a first end of a corresponding switch circuit in the second sub-switch module via a corresponding switch circuit in the third sub-switch module, outputting the two clock signal groups, including the plurality of sub-clock signals, to the two shift registers located on the display panel, respectively via the plurality of the switch circuits in the first switch module and the plurality of the switch circuits in the second switch module, a controlled end of each of the switch circuits is respectively connected to the control end of the control module.

Optionally, the plurality of switch circuits of each sub-switch module are linked together.

Optionally, each of the switch circuits is a metal-oxide semiconductor field effect transistor.

Optionally, each of the switch circuits is a triode.

Optionally, the current detecting module includes a plurality of sub-current detecting modules, each of the sub-current detecting modules respectively detects current of each of the sub-clock signals, and feeds back current signal to the control module.

Optionally, the potential enhancing module, the current detecting module, the switch module and the control module are integrated on the level shifter chip.

The present disclosure further provides a display device. The display device includes a level shifter chip, the level shift chip includes a driving circuit, the driving circuit includes:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively including a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups, and feed back a plurality of current signals to the control module; and a control module, configured to receive the plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

In the technical solution of the present disclosure, the potential enhancing module, the current detecting module, the switch module and the control module are included in the driving circuit. The potential enhancing module performs potential enhancement on a low voltage logical signal input by the timing sequence controller, and divides the low voltage logical signal after the potential enhancement into two clock signal groups including a plurality of sub-clock signals, then the two clock signal groups are output to the two shift registers on the display panel, so as to realize the bilateral driving to drive the display panel. The current detecting module detects current value of each of the clock signals, and feeds back the current value to the control module. When one of the shift registers on the display panel is damaged, the current of the clock signal output to the shift register is abnormal. The control module, according to the current signal fed back by the current detecting module, correspondingly outputs the control signal to the switch module, so as to switch off the clock signal output to the shift register, and superimposes the clock signal group with the other clock signal group, to realize the unilateral driving. As such, different abnormal states of the shift registers located at both ends of the display panel could be dynamically matched, and for a large-size panel which works in the unilateral driving status, the problem that charging time for the remote may be insufficient has been solved, improving the compatibility of the driver board.

BRIEF DESCRIPTION OF THE DRAWINGS

In order to more clearly illustrate the embodiments of the present disclosure or the technical solutions in the prior art, the drawings used in the embodiments or the prior art description will be briefly introduced below. Obviously, the drawings in the following description are merely some of the embodiments of the present disclosure, and those skilled in the art can obtain other drawings according to the structures shown in the drawings without any creative work.

The realizing of the aim, functional characteristics and advantages of the present disclosure are further described in detail with reference to the accompanying drawings and the embodiments.

DETAILED DESCRIPTION OF THE EMBODIMENTS

The technical solutions in the embodiments of the present disclosure will be described clearly and completely combining the drawings in the embodiments of the present disclosure. Obviously, the described embodiments are only a part of the embodiments of the present disclosure, but not all of them. Based on the embodiments in the present disclosure, all other embodiments obtained by those skilled in the art without creative work shall belong to the protection scope of the present disclosure.

It should be noted that, terms such as "first" and "second" are used herein for purposes of description and are not intended to indicate or imply relative importance or to imply the number of indicated technical features. Thus, the features defined with "first" and "second" may comprise or imply at least one of these features. Moreover, the meaning of "and/or" appearing in the full text is: including three parallel solutions. Taking "A/B" as an example, it includes the A plan, or the B plan, or the plan satisfying A and B simultaneously. In addition, the technical solutions between the various embodiments of the present disclosure may be combined with each other, but must be based on the realization of those skilled in the art. When the combination of technical solutions is contradictory or impossible to implement, it should be considered that the combination of the technical solutions does not exist, and not within the scope of protection required by this disclosure.

Figure 1:
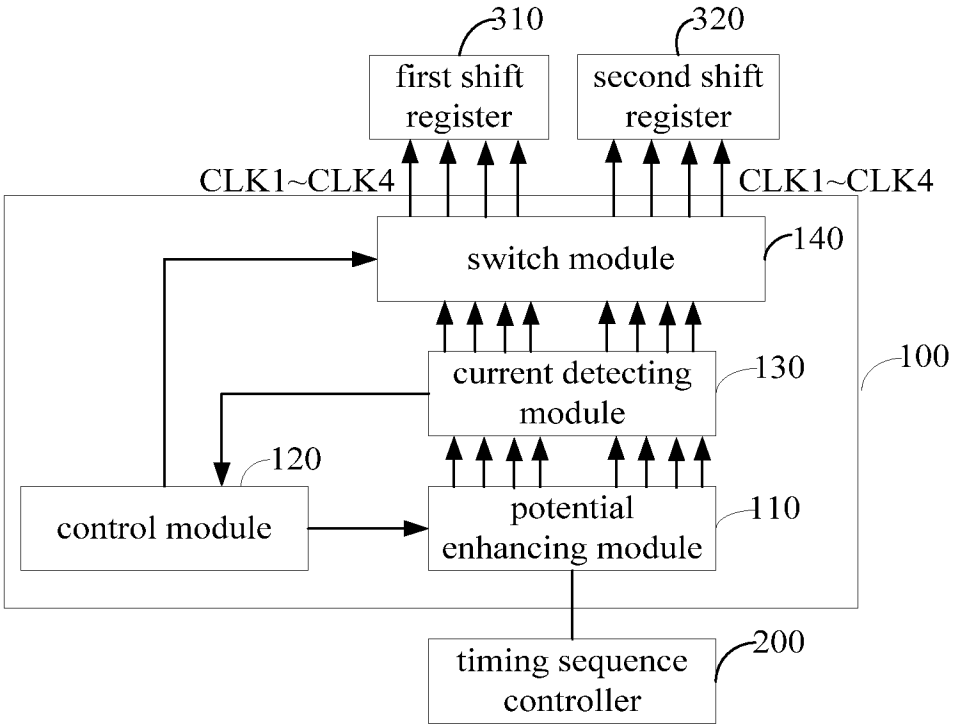
FIG. 1 is a functional module diagram of a driving circuit of an embodiment according to the present disclosure.

The driving circuit 100 of the present disclosure is adapted for a display panel with a large-size. The driving circuit 100 is a driving circuit, and is configured to output a gate driving signal to a gate line of the display panel, to switch on the gate line. For a large-size panel, the load on the gate line is large. In order to normally switch on the gate line, the GOA adopts a bilateral driving, that is, shift registers on the left and right sides charge a row of gate line. When the shift register on one side is damaged, insufficient charging would be caused. Therefore, input current of the input signal of the other side needs to be increased. As shown in FIG. 1, FIG. 1 is a functional module diagram of a driving circuit of an embodiment according to the present disclosure, the driving circuit 100 includes:

a potential enhancing module 110, configured to divide a clock signal output by a timing sequence controller 200 into two clock signal groups after the clock signal being potential enhanced by the potential enhancing module 110, and correspondingly output the two clock signal groups to two shift registers on a display panel, the two clock signal groups respectively comprising a plurality of sub-clock signals;

a switch module 140, connected in series between the potential enhancing module 110 and the shift registers located at both ends of the display panel, and configured to correspondingly switch on or off according to a received switch control signal;

a current detecting module 130, connected in series between the potential enhancing module 110 and the switch module 140, or connected in series between the switch module 140 and the shift registers located at both ends of the display panel, configured to respectively detect output current of each sub-clock signal in the two clock signal groups, and feed back a plurality of current signals to the control module 120; and a control module 120, configured to receive the plurality of current signals output by the current detecting module 130, and compare current values corresponding to the plurality of current signals with a preset current threshold, when the current value of any one of the sub-clock signals in one of the clock signal groups is less than the preset current threshold, output a control signal to the switch module 140, to control the switch module 140 to cut off the output of the clock signal group, and superimpose the clock signal group with the other clock signal group to output to the other shift register.

In this embodiment, the display panel includes but not limited to a liquid display panel, an organic light emitting diode display panel, a field emission display panel, a plasma display panel, and a curved surface panel. The liquid display panel includes a thin film transistor liquid crystal display panel, a twisted nematic (TN) display panel, a vertical alignment (VA) display panel, an in-plane switching (IPS) display panel and so on. The shift registers disposed at both ends of the display panel, for example, a first shift register 310 and a second shift register 320, receive the plurality of clock signals output by the driving circuit 100, and drive pixels inside the display panel to work. The clock signals received by the shift registers at both ends are identical, and each clock signal is one cycle ahead of the previous clock signal. It is assumed that the clock signals output by the driving circuit 100 to the shift registers at both ends are respectively CLK1 to CLK4, CLK2 is ¼ cycle ahead of CLK1, and CLK3 is ¼ cycle ahead of CLK2. The driving circuit 100 may output 6 sub-clock signals or 8 sub-clock signals according to needs. By using more CLK signals, the load of each of signal lines and power consumption could be reduced, however, the number of pins in the circuit would be increased. In actual design, the number of clock signals output could be selected according to boarder width, product size, integrated circuit design, resolution of the specific product, and so on.

The potential enhancing module 110 receives a low level clock signal output by the timing sequence controller 200, and shifts the level of the clock signal under the modulation of the control module 120, so as to enhance the potential of the low level clock signal and output two identical clock signal groups. Each clock signal group includes a plurality of sub-clock signals, the number of the sub-clock signals could be determined according to requirements, for example, 4, 6, 8, and so on. The clock signal groups, which is output by the potential enhancing module 110, are output to the two shift registers located at both ends of the display panel via the current detecting module 130, and the switch module 140. The current detecting module 130 respectively detects current value of each of the sub-clock signals. The current detecting module 130 may select a circuit, such as a sampling resistor or a transformer, for current detection. The switch module 140 may select a plurality of switch components or switch circuits with switching capability, such as relays, field effect transistors, triode, and so on. In some embodiments, one switch controls the signal output of one clock signal group, or one switch controls the output of one sub-clock signal. A controlled end of the switch is connected to a control end of the control module 120, and performs switch-on or switch-off according to the control signal output by the control module 120. The control module 120 may select a microprocessor, a programmable single chip microcomputer, and so on. And a comparator circuit could be build on the periphery for voltage comparison, and specifically arranged according to actual conditions. Thus, they are not limited herein.

In some embodiments, a signal input end of the potential enhancing module 110 is connected to a signal output end of the timing sequence controller 200, a signal output end of the potential enhancing module 110 is connected to a signal input end of the current detecting module, a signal output end of the current detecting module 130 is connected to a signal input end of the switch module 140, a first signal output end of the switch module 140 is connected to a signal input end of the first shift register 310 of the display panel, a second signal output end of the switch module 140 is connected to a signal input end of the second shift register 320 of the display panel, a controlled end of the potential enhancing module 110, the signal output end of the current detecting module 130, and the controlled end of the switch module 140 are all connected to a signal end of the control module 120.

The current detecting module 130 may be disposed at the front end or the rear end of the switch module 140, which could be determined according to the position of the driver board. Thus, it is not limited herein. In this embodiment, the current detecting module 130 is disposed at the front end of the switch module 140, the signal output end of the switch module 140 is respectively connected to the signal input ends of the two shift registers. When the shift registers located at both ends of the display panel are both normal, the bilateral driving is implemented. When one of the shift registers is damaged, all or a single sub-clock signal, correspondingly output to the shift register, could not be input normally, causing an abnormal driving. The current detecting module 130 detects the current value of each sub-clock signal, and feeds back the current value of each sub-clock signal to the control module 120. When the current value of one of the sub-clock signals, output to the first shift register 310 or the second shift register 320, is smaller than a preset current threshold, the control module 120, according to the comparison between the current value with the preset current threshold, determines that the shift register with a smaller current is abnormal, and outputs the control signal to the switch module 140. The sub-switch modules 140 inside the switch module 140 correspondingly switch on or switch off, so that the clock signal group output to the shift register with a smaller current is cut off, and this clock signal group is superimposed with the other clock signal group which is normally output. Corresponding sub-clock signals are superimposed, for example, CLK1 output to the first shift register 310 is superimposed with CLK1 output to the second shift register 320, CLK2 is superimposed with CLK2, so as to realize the unilateral driving with large current, and increase the driving current of the display panel. If the two shift registers are both damaged, the two clock signal groups are both cut off, and the shift registers are to be repaired or replaced. so as to realize the unilateral driving. If the two shift register groups are both damaged, the two clock signal groups are both cut off, and the shift registers are to be repaired or replaced.

The driving circuit 100 may be configured to drive a medium-size or large-size display panel. When the shift registers located at both ends of the display panel are normal, the bilateral driving is implemented; when one of the shift registers has an abnormality, the unilateral driving is automatically switched to, and by the corresponding superimposing of signals, the output current of the unilateral driving is increased. The driving circuit 100 is mounted on the driver board, which could drive the left side, the right side, or both the left side and the right side. As such, there is no need to design three kinds of driver boards, improving the compatibility of the driver board, solving the problem that the charging time for the remote may be insufficient when unilateral driving, and reducing the design costs.

In the technical solution of the present disclosure, the driving circuit 100 is formed by the potential enhancing module 110, the current detecting module 130, the switch module 140 and the control module 120. The potential enhancing module 110 enhances the potential of the clock signal output by the timing sequence controller 200, divides the clock signal into two clock signal groups including a plurality of sub-clock signals, and outputs the two clock signal groups to the two shift registers on the display panel, so as to bilaterally drive the display panel. The current detecting module 130 detects the current value of each clock signal, then feeds back the current value to the control module 120. When one of the shift registers on the display panel is damaged, the current of the clock signal output to the shift register is abnormal. The control module 120 correspondingly outputs the control signal to the switch module 140 according to the current signal fed back by the current detecting module 130, to switch off the clock signal output to the shift register, and superimpose this clock signal group with the other clock signal group, so as to realize the unilateral driving with large current. As such, different abnormal states of the shift registers located at both ends of the display panel could be dynamically matched, solving the problem that the charging time for the remote may be insufficient when unilateral driving, improving the compatibility of the driver board.

Figure 2:
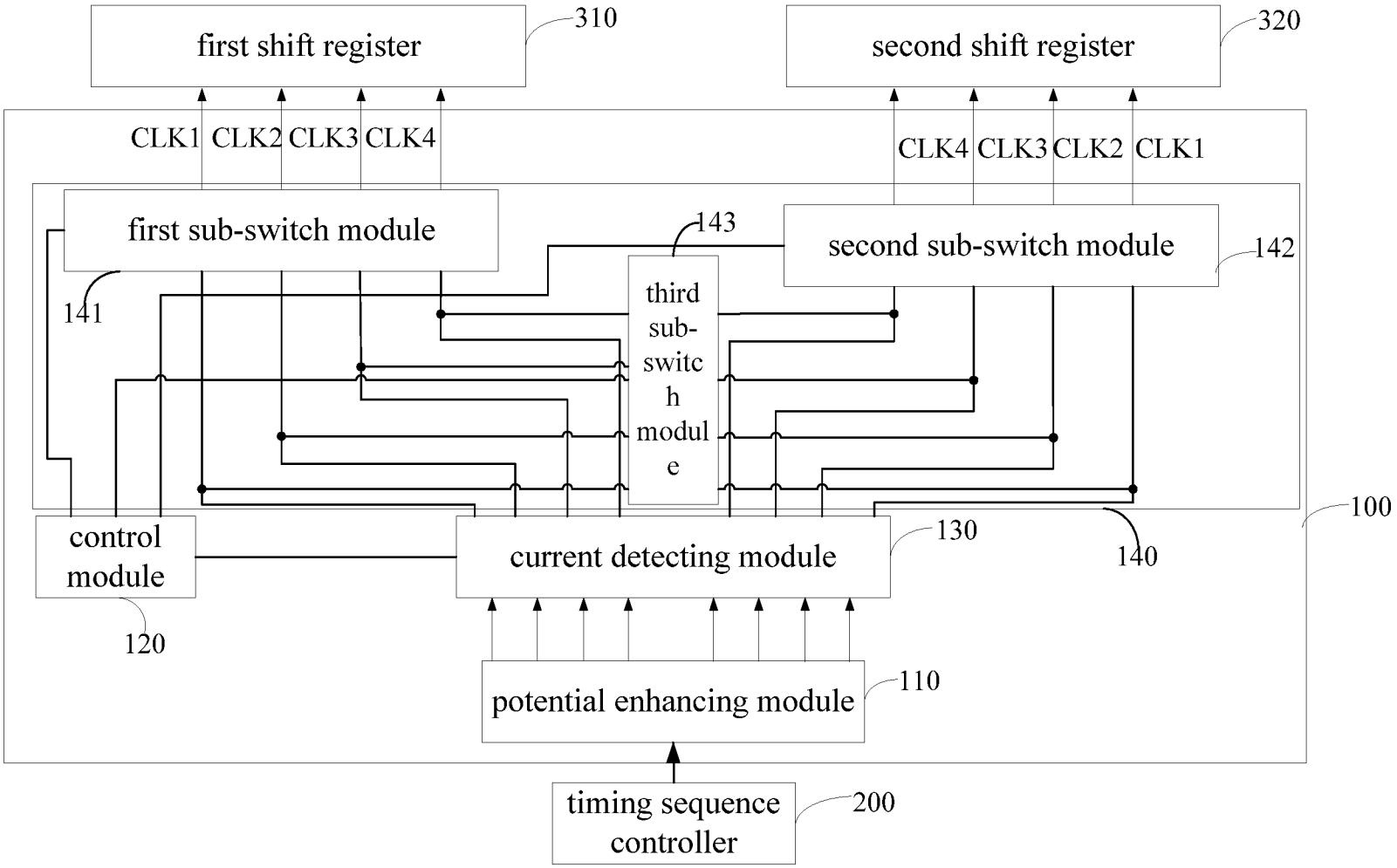
FIG. 2 is a functional module diagram of a driving circuit of another embodiment according to the present disclosure.

In some embodiments, as shown in FIG. 2, FIG. 2 is a functional module diagram of a driving circuit of another embodiment according to the present disclosure. The switch module 140 includes a first sub-switch module 141, a second sub-switch module 142 and a third sub-switch module 143. The first signal end of the first sub-switch module 141 and the first signal end of the third sub-switch module 143 are connected to the first signal output end of the current detecting module 130, the second signal end of the first sub-switch module 141 is connected to the signal end of the first shift register 310 of the display panel, the first signal end of the second sub-switch module 142, and the second signal end of the third sub-switch module 143 are connected to the second signal output end of the current detecting module 130, the second signal end of the second sub-switch module 142 is connected to the signal end of the second shift register of the display panel, the controlled end of the first sub-switch module 141, the controlled end of the second sub-switch module 142, and the controlled end of the third sub-switch module 143, are all connected to the control end of the control module 120.

In this embodiment, the two clock signal groups are output to the corresponding shift register, via the first sub-switch module 141 and the second sub-switch module 142 respectively, so as to realize the bilateral driving. The first sub-switch module 141 and the second sub-switch module 142 simultaneously control the output of the plurality of sub-clock signals. Initially, the first sub-switch module 141 and the second sub-switch module 142 remain on status. And the third sub-switch module 143 is connected in series between the signal input end of the first sub-switch module 141 and the signal input end of the second sub-switch module 142, the third sub-switch module 143 is initially off. When one of the two shift registers is damaged, for example, the first shift register 310, the current of the clock signals output to the first shift register 310 is abnormal. The abnormality may be that the current of one of the sub-clock signals is small, or the current of multiple of the sub-clock signals are small. When the current value is smaller than the preset current threshold, the control module 120 outputs the control signal to the first sub-switch module 141, the second sub-switch module 142 and the third sub-switch module 143. The first sub-switch module 141 is switched off, to cut off the plurality of sub-clock signals output to the first shift register 310; the third sub-switch module 143 is switched on, and the clock signal group output to the first shift register 310 is output to the second shift register 320 via the third sub-switch module 143, so as to realize the unilateral driving, improving the compatibility of the driver board, and solving the problem that charging time for the remote may be insufficient.

The first sub-switch module 140, the second sub-switch module 142 and the third sub-switch module 143 may use multiple-input and multi-output relays or other switch components, and could be designed according to actual conditions, which is not limited herein.

Figure 3:
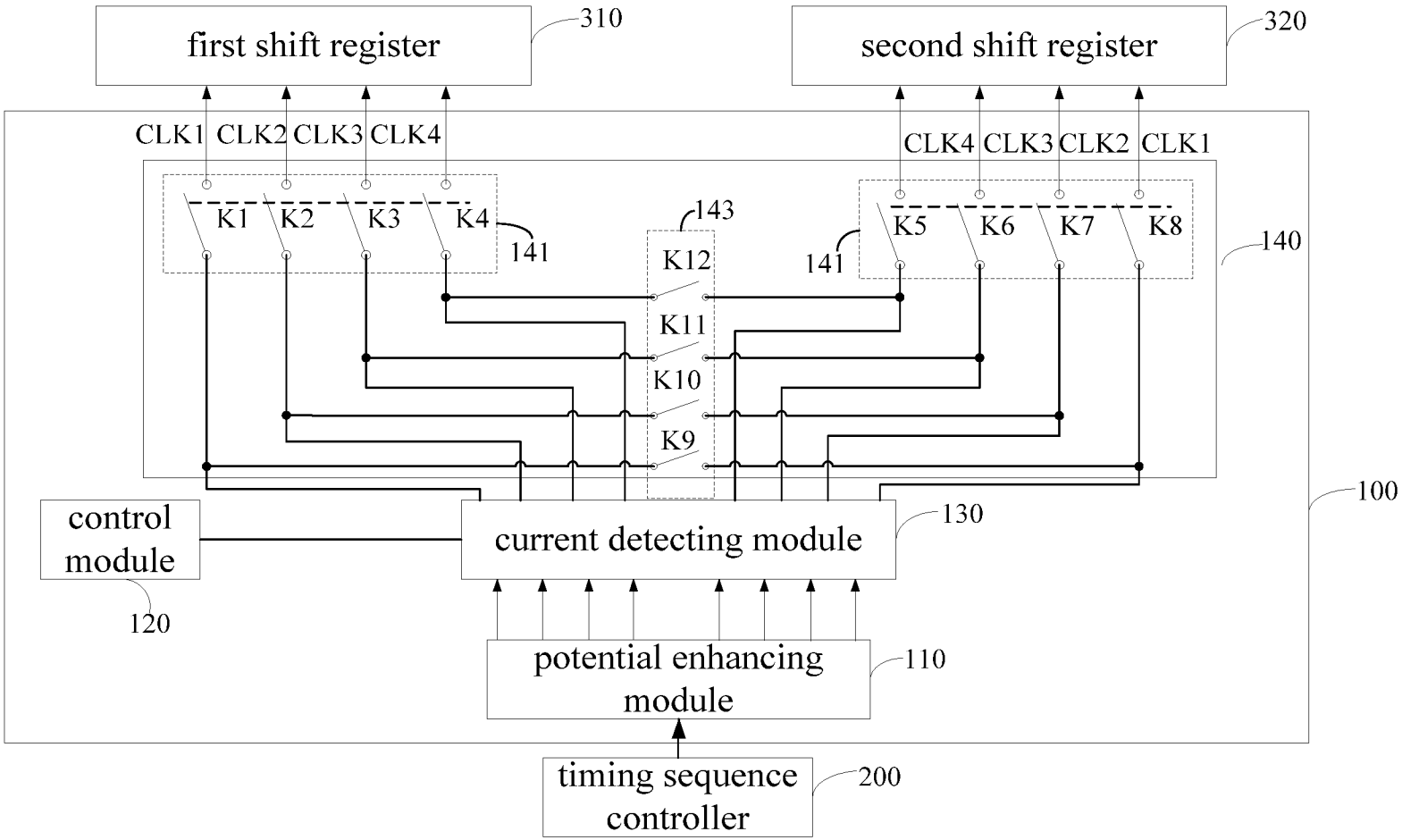
FIG. 3 is a functional module diagram of a driving circuit of another embodiment according to the present disclosure.

In some embodiments, as shown in FIG. 3, FIG. 3 is a functional module diagram of a driving circuit of another embodiment according to the present disclosure. The first sub-switch module 140, the second sub-switch module 142 and the third sub-switch module 143 all include a plurality of switch circuits. The first end of each switch circuit in the first sub-switch module 141 is connected to the first end of the corresponding switch circuit in the second sub-switch module 142, via the corresponding switch circuit in the third sub-switch module 143. The two clock signal groups, including the plurality of sub-clock signals, are output to the two shift registers on the display panel, respectively via the plurality of switch circuits of the first switch module 140 and the plurality of switch circuits of the second switch module 140. The controlled end of each of the switch circuits is respectively connected to the control end of the control module 120.

In some embodiments, each sub-switch module 140 includes a plurality of switch circuits, for example, the K1 to K12 in the figures. The plurality of the switch circuits in the first sub-switch module 14 land the plurality of the switch circuits in the second sub-switch module 142, correspond to the clock signals output by the potential enhancing module 110 one by one. The switch circuits in the first sub-switch module 141, the switch circuits in the second sub-switch module 142 are connected in series between the current detecting module 130 and the shift registers, and configured to control the output of each of the sub-clock signals. The plurality of the switch circuits in the third sub-switch module 143 are connected in series between the plurality of the switch circuits in the first sub-switch module 141 and the plurality of the switch circuits in the second sub-switch module 142. The plurality of the switch circuits in one sub-switch module 140 act simultaneously, for example, as shown in FIG. 3, K1 to K4 switch on or off simultaneously, K5 to K8 switch on or off simultaneously, K9 to K12 switch on or off simultaneously, so that the synchronous control of the plurality of sub-clock signals in the clock signal group is realized, and under the control of the control module 120, the bilateral driving and the unilateral driving with large current are switched automatically.

In some embodiments, each switch circuit is a metal-oxide semiconductor field effect transistor.

When the number of the sub-switch circuits included in the sub-switch module 140 is equal to the number of the sub-clock signals, each switch circuit may use a metal-oxide semiconductor field effect transistor. The gate of the metal-oxide semiconductor field effect transistor is the controlled end of the sub-switch module 140, and connected to the control end of the control module 120. The metal-oxide semiconductor field effect transistor may be a n-channel metal-oxide semiconductor field effect transistor or a p-channel metal-oxide semiconductor field effect transistor. When the n-channel metal-oxide semiconductor field effect transistor is selected, the control module 120 outputs a high level to the metal-oxide semiconductor field effect transistor to switch it on, and outputs a low level to the metal-oxide semiconductor field effect transistor to switch it off. When the p-channel metal-oxide semiconductor field effect transistor is selected, the control module 120 outputs a low level to the metal-oxide semiconductor field effect transistor to switch it on, and outputs a high level to the metal-oxide semiconductor field effect transistor to switch it off. The type of the metal-oxide semiconductor field effect transistor could be flexibly selected, which is not limited herein.

In some embodiments, each switch circuit is a triode.

When the number of the switch circuits included in the sub-switch module 140 is equal to the number of the sub-clock signals, each switch circuit may use a triode. The base of the triode is taken as the controlled end of the switch circuit and connected to the control end of the control module 120. The triode may select a NPN transistor or a PNP transistor. When the NPN transistor is selected, the control module 120 outputs a high level to the switch module 140 to switch it on, and outputs a low level to switch it off. Accordingly, when the PNP transistor is selected, the control module 120 outputs a low level to the switch module 140 to switch it on, and outputs a high level to switch it off. The type of triode could be flexibly selected, which is not limited herein.

In some embodiments, the current detecting module 130 includes a plurality of sub-current detecting modules 130. Each of the sub-current detecting modules 130 respectively detects the current of each of the sub-clock signals, and feeds back the current signal to the control module 120.

It should be noted that, the plurality of sub-current detecting modules 130 are configured to detect sub-clock signals output by the potential enhancing module 110. The number of sub-current detecting modules 130 is equal to the number of the sub-clock signals, and the sub-current detecting modules correspond to the sub-clock signals one by one. Each sub-current detecting module 130 detects the corresponding sub-clock signal and feeds back the current signal to the control module 120. The sub-current detecting module 130 may use a circuit, such as a current transformer or a sampling resistor, for current detecting, which could be set according to specific conditions.

Figure 4:
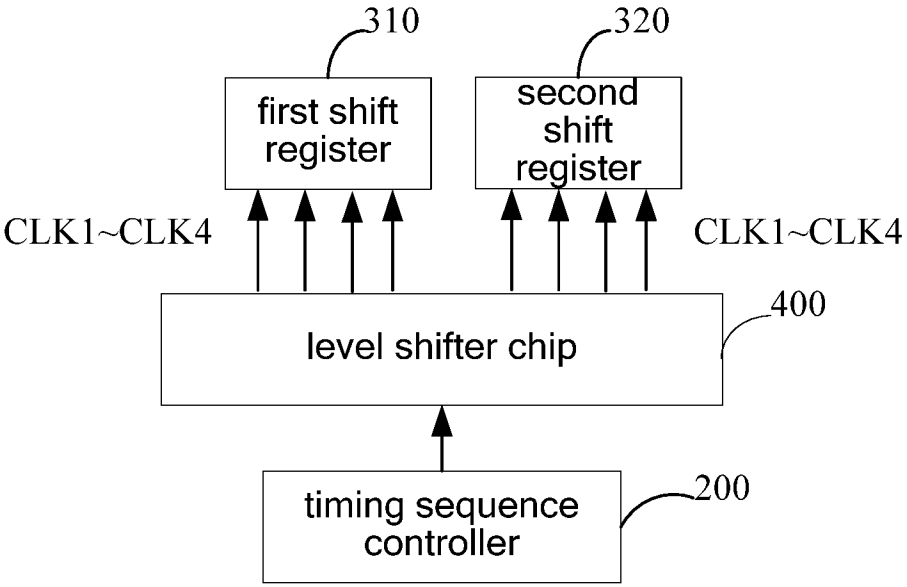
FIG. 4 is a functional module diagram of a level shifter chip of an embodiment according to the present disclosure.

Further, as shown in FIG. 4, FIG. 4 is a functional module diagram of an embodiment of the potential enhancing chip 400 of the present disclosure. The present disclosure also provides a potential enhancing chip 400, which includes the driving circuit 100 as described above.

It should be noted that, the GOA circuit is a circuit in which the original Gate IC is divided into two parts including a level shifter chip 400 and a shift register. The level shifter chip 400 is manufactured on the driver board, and the shift register is on the panel. The level shifter chip 400 transmits CLK to the shift register for driving. As such, the structure of the Gate IC is simplified, and further, the border length is reduced. Therefore, the potential enhancing module 110 in the driving circuit 100 could be used as the potential enhancing chip 400 alone, or the potential enhancing module 110, the current detecting module 130, the switch module 140 and the control module 120 are integrated in the potential enhancing chip 400, to further reduce the boarder length. In this embodiment, the second way is adopted, namely, the potential enhancing module 110, the current detecting module 130, the switch module 140 and the control module 120 are integrated in the potential enhancing chip 400.

The present disclosure also provides a display device including a level shifter chip 400. The specific structure of the level shifter chip 400 is described with reference to the above embodiments. All the beneficial effects of the technical solutions of the above embodiments are achieved because the display device adopts all the technical solutions of all the above embodiments, which will not be described in detail herein.

The foregoing description merely portrays some illustrative embodiments in accordance with the disclosure and therefore is not intended to limit the patentable scope of the disclosure. Any equivalent structure or flow transformations that are made taking advantage of the specification and accompanying drawings of the disclosure and any direct or indirect applications thereof in other related technical fields shall all fall in the scope of protection of the disclosure.

What is claimed is:

1. A driving circuit, wherein, the driving circuit comprises:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively comprising a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups; and a control module, configured to receive a plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

2. The driving circuit of claim 1, wherein, a signal input end of the potential enhancing module connects to a signal output end of the timing sequence controller, a signal output end of the potential enhancing module connects to a signal input end of the current detecting module, a signal output end of the current detecting module connects to a signal input end of the switch module, a first signal output end of the switch module connects to a signal input end of the first shift register of the display panel, a second signal output end of the switch module connects to a signal input end of the second shift register of the display panel, a controlled end of the potential enhancing module, the signal output end of the current detecting module, and a controlled end of the switch module all connect to a signal end of the control module.

3. The driving circuit of claim 1, wherein, the switch module comprises a first sub-switch module, a second sub-switch module and a third sub-switch module, a first signal end of the first sub-switch module, a first signal end of the third switch are connected to a first signal output end of the current detecting module, a second signal end of the first sub-switch module is connected to a signal end of the first shift register of the display panel, a first signal end of the sub-second switch module, a second signal end of the third sub-switch module are connected to the second signal output end of the current detecting module, a second signal end of the second sub-switch module is connected to a signal end of the right shift register of the display panel, a controlled end of the first sub-switch module, a controlled end of the second sub-switch module and a controlled end of the third sub-switch module are connected to a control end of the control module.

4. The driving circuit of claim 3, wherein, the first sub-switch module, the second sub-switch module and the third sub-switch module all comprise a plurality of switch circuits, a first end of each of the switch circuits in the first sub-switch module is connected to a first end of a corresponding switch circuit in the second sub-switch module via a corresponding switch circuit in the third sub-switch module, outputting the two clock signal groups, comprising the plurality of sub-clock signals, to the two shift registers located on the display panel, respectively via the plurality of the switch circuits in the first switch module and the plurality of the switch circuits in the second switch module, a controlled end of each of the switch circuits is respectively connected to the control end of the control module.

5. The driving circuit of claim 4, wherein, the plurality of switch circuits of each sub-switch module are linked together.

6. The driving circuit of claim 4, wherein, each of the switch circuits is a metal-oxide semiconductor field effect transistor.

7. The driving circuit of claim 4, wherein, each of the switch circuits is a triode.

8. The driving circuit of claim 1, wherein, the current detecting module comprises a plurality of sub-current detecting modules, each of the sub-current detecting modules respectively detects current of each of the sub-clock signals, and feeds back current signal to the control module.

9. A level shifter chip, wherein, the level shifter chip comprises a driving circuit, the driving circuit comprises:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively comprising a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups; and a control module, configured to receive a plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

10. The level shifter chip according to claim 9, wherein, a signal input end of the potential enhancing module connects to a signal output end of the timing sequence controller, a signal output end of the potential enhancing module connects to a signal input end of the current detecting module, a signal output end of the current detecting module connects to a signal input end of the switch module, a first signal output end of the switch module connects to a signal input end of the first shift register of the display panel, a second signal output end of the switch module connects to a signal input end of the second shift register of the display panel, a controlled end of the potential enhancing module, the signal output end of the current detecting module, and a controlled end of the switch module all connect to a signal end of the control module.

11. The level shifter chip according to claim 9, wherein, the switch module comprises a first sub-switch module, a second sub-switch module and a third sub-switch module, a first signal end of the first sub-switch module, a first signal end of the third switch are connected to a first signal output end of the current detecting module, a second signal end of the first sub-switch module is connected to a signal end of the first shift register of the display panel, a first signal end of the sub-second switch module, a second signal end of the third sub-switch module are connected to the second signal output end of the current detecting module, a second signal end of the second sub-switch module is connected to a signal end of the right shift register of the display panel, a controlled end of the first sub-switch module, a controlled end of the second sub-switch module and a controlled end of the third sub-switch module are connected to a control end of the control module.

12. The level shifter chip according to claim 9, wherein, the first sub-switch module, the second sub-switch module and the third sub-switch module all comprise a plurality of switch circuits, a first end of each of the switch circuits in the first sub-switch module is connected to a first end of a corresponding switch circuit in the second sub-switch module via a corresponding switch circuit in the third sub-switch module, outputting the two clock signal groups, comprising the plurality of sub-clock signals, to the two shift registers located on the display panel, respectively via the plurality of the switch circuits in the first switch module and the plurality of the switch circuits in the second switch module, a controlled end of each of the switch circuits is respectively connected to the control end of the control module.

13. The level shifter chip according to claim 12, wherein, the plurality of switch circuits of each sub-switch module are linked together.

14. The level shifter chip of claim 12, wherein, each of the switch circuits is a metal-oxide semiconductor field effect transistor.

15. The level shifter chip of claim 12, wherein, each of the switch circuits is a triode.

16. The level shifter chip of claim 9, wherein, the current detecting module comprises a plurality of sub-current detecting modules, each of the sub-current detecting modules respectively detects current of each of the sub-clock signals, and feeds back current signal to the control module.

17. The level shifter chip of claim 9, wherein, the potential enhancing module, the current detecting module, the switch module and the control module are integrated on the level shifter chip.

18. A display device, wherein, the display device comprises a level shifter chip, the level shifter chip comprises a driving circuit, the driving circuit comprises:

a potential enhancing module, configured to divide a clock signal output by a timing sequence controller into two clock signal groups after the clock signal being potential enhanced by the potential enhancing module, and correspondingly output the two clock signal groups to two shift registers on a display panel, the two clock signal groups respectively comprising a plurality of sub-clock signals;

a switch module, connected in series between the potential enhancing module and the shift registers located at both ends of the display panel, and configured to correspondingly switch on or off according to a received switch control signal;

a current detecting module, connected in series between the potential enhancing module and the switch module, or connected in series between the switch module and the shift registers located at both ends of the display panel, configured to respectively detect output current of each sub-clock signal in the two clock signal groups; and a control module, configured to receive a plurality of current signals output by the current detecting module, and compare current values corresponding to the plurality of current signals with a preset current threshold, when the current value of any one of the sub-clock signals in one of the clock signal groups is less than the preset current threshold, output a control signal to the switch module, to control the switch module to cut off the output of the clock signal group, and superimpose the clock signal group with the other clock signal group to output to the other shift register.

* * * * *